US009478907B2

(12) United States Patent
Mastel

(10) Patent No.: US 9,478,907 B2
(45) Date of Patent: Oct. 25, 2016

(54) PLUG-TYPE CONNECTOR ARRANGEMENT AND DETACHMENT ELEMENT THEREFOR

(71) Applicant: WAGO Verwaltungsgesellschaft mbH, Minden (DE)

(72) Inventor: Rudolf Mastel, Porta Westfalica (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 14/730,325

(22) Filed: Jun. 4, 2015

(65) Prior Publication Data

US 2015/0357754 A1 Dec. 10, 2015

(30) Foreign Application Priority Data

Jun. 5, 2014 (DE) ..... 10 2014 107 950

(51) Int. Cl.
*H01R 13/627* (2006.01)
*H01R 24/68* (2011.01)
*H01R 13/633* (2006.01)

(52) U.S. Cl.
CPC ..... *H01R 13/6273* (2013.01); *H01R 13/6335* (2013.01); *H01R 24/68* (2013.01)

(58) Field of Classification Search
CPC ..... H01R 13/6275; H01R 13/6272; H01R 13/633; H01R 13/639
See application file for complete search history.

(56) References Cited

U.S. PATENT DOCUMENTS 3,946,346 A * 3/1976 Oster ..... H01H 9/42 335/16
5,164,693 A * 11/1992 Yokoyama ..... H01H 9/46 335/14

(Continued)

FOREIGN PATENT DOCUMENTS

DE 20 2005 003654 U1 5/2005
DE 10 2005 058 969 1/2008

(Continued)

OTHER PUBLICATIONS

European Search Report dated Oct. 13, 2015 for corresponding European Application No. 15170672.8.

*Primary Examiner* — Truc Nguyen
(74) *Attorney, Agent, or Firm* — Renner, Otto, Boisselle & Sklar, LLP

(57) ABSTRACT

A plug-type connector arrangement comprising a plug-type connector and an opposing plug-type connector, which each have an insulating housing and plug-type contact elements in the insulating housing and are designed for plugging together and for making electrical contact with assigned plug-type contact elements in the plugged-together state, is described. The opposing plug-type connector has at least one latching lug. The plug-type connector has at least one latching element, which is designed so as to interact with the latching lug in the plugged-together state so as to fasten the plug-type connector on the opposing plug-type connector. At least one detachment element provided for unlocking the latching lug is arranged displaceably on the plug-type connector. The detachment element has an actuating member, which has a first actuating section, which is connected to the detachment element, and a second actuating section, which is mounted movably relative to the first actuating section and interacts with the plug-type connector. The first actuating section and the second actuating section form a toggle-lever mechanism for displacing the detachment element in the event of the action of force on the actuating member.

19 Claims, 15 Drawing Sheets

(56) References Cited

U.S. PATENT DOCUMENTS

| | | | | |
|---|---|---|---|---|
| 5,252,933 | A * | 10/1993 | Kamino | H01H 89/08 335/172 |
| 5,564,939 | A | 10/1996 | Maitani et al. | |
| 2003/0142917 | A1 | 7/2003 | Merrick | |
| 2007/0171016 | A1* | 7/2007 | Bonjean | H01H 33/6662 335/234 |
| 2011/0115494 | A1* | 5/2011 | Taylor | H01R 13/514 324/537 |
| 2011/0201224 | A1 | 8/2011 | Hanson et al. | |
| 2012/0313580 | A1 | 12/2012 | Charnesky et al. | |
| 2013/0264311 | A1* | 10/2013 | Lang | H01H 1/2025 218/2 |
| 2013/0313228 | A1* | 11/2013 | Friedrichsen | H01H 1/20 218/23 |
| 2014/0061160 | A1* | 3/2014 | Juds | H01H 9/443 218/26 |
| 2014/0284310 | A1* | 9/2014 | Gerving | H01H 9/36 218/26 |
| 2015/0048908 | A1* | 2/2015 | Isozaki | H01H 1/54 335/6 |
| 2015/0070114 | A1* | 3/2015 | Fasano | H01H 71/32 335/21 |

FOREIGN PATENT DOCUMENTS

| | | | |
|---|---|---|---|
| DE | 20 2008 007149 | U1 | 7/2008 |
| DE | 10 2009 018 715 | | 11/2010 |
| DE | 10 2006 054 648 | | 5/2012 |
| DE | 10 2011 102715 | A1 | 11/2012 |
| DE | 10 2012 208 661 | | 12/2012 |
| EP | 2 337 163 | | 6/2011 |
| JP | 5 500744 | B1 | 5/2014 |
| WO | 2009/149401 | | 12/2009 |

* cited by examiner

PLUG-TYPE CONNECTOR ARRANGEMENT AND DETACHMENT ELEMENT THEREFOR

The invention relates to a plug-type connector arrangement comprising a plug-type connector and an opposing plug-type connector, which each have an insulating housing and plug-type contact elements in the insulating housing and are designed for plugging together and for making electrical contact with assigned plug-type contact elements in the plugged-together state, wherein the opposing plug-type connector has at least one latching lug, and the plug-type connector has at least one latching element, which is designed so as to interact with the latching lug in the plugged-together state so as to fasten the plug-type connector on the opposing plug-type connector, and wherein at least one detachment element provided for unlocking the latching lug is arranged displaceably on the plug-type connector.

In order to fasten a plug-type connector on an assigned opposing plug-type connector in the plugged-together state, locking mechanisms are required.

The invention furthermore relates to a detachment element for such a plug-type connector arrangement.

DE 10 2005 058 969 B4 describes such a locking apparatus for a male connector part and a base strip of an electrical plug-type connector in which a slide is guided displaceably in the longitudinal direction on the male connector part. A locking element arranged pivotably on the male connector part engages with pins in sloping slots in the slide so that the pivoting arm with its latching hook at the free end is pivoted on displacement of the slide and can be latched on a latching tab of the base strip.

DE 10 2006 054 648 B4 discloses an electrical plug-type connector coupling comprising a latching tongue as connecting means and comprising at least one detachment element guided displaceably on the housing narrow side of a male connector housing. The free end of the detachment element facing the latching tongue tapers conically in order to engage beneath the latching tongue and to cancel the connection between the plug-type connector and the opposing plug-type connector.

DE 10 2009 018 715 A1 discloses a fastening apparatus for fastening an attachment male connector on a basic housing. The attachment male connector has a male connector housing comprising a screw shaft. The fastening element for fastening the attachment male connector on the basic housing can be fastened firstly on the screw shaft of the male connector housing and secondly on an outer face of the basic housing. Thus, no additional receiving elements are required anymore for the fastening element.

DE 10 2012 208 661 A1 describes a secondary safety release mechanism for unlocking and unblocking a charging cable with a locking bolt for locking the charging cable in the charging connection.

WO 2009/149401 A1 discloses a plug-type connector arrangement comprising an elastic locking lug, under which a pivotably mounted unlocking arm engages in order to open the locking lug by virtue of pivoting of the unlocking arm.

EP 2 337 163 A1 discloses a plug-type connector arrangement comprising a locking arm, which, with one of its free ends, bears against a male connector and, with its opposite free end, latches with an opposing male connector. The detachment element is in this case positioned on the plug-type connector arrangement and is not guided any further on the plug-type connector arrangement. The detachment element is configured in the manner of a toggle-lever mechanism in order to detach the plug-type connector from the opposing plug-type connector when a compressive force is exerted on the detachment element.

Against this background, the object of the present invention consists in providing an improved plug-type connector arrangement and providing an improved detachment element which enables convenient unlocking of a latching lug of an opposing plug-type connector given a simple and compact design.

The object is achieved by the plug-type connector arrangement having the features of claim 1 and by the detachment element having the features of claim 13. Advantageous embodiments are described in the dependent claims.

It is proposed that the detachment element has an actuating member, which has a first actuating section, which is connected to the detachment element, and a second actuating section, which is mounted movably relative to the first actuating section and interacts with the plug-type connector. The first actuating section and the second actuating section form a toggle-lever mechanism for displacing the detachment element in the event of the action of force on the actuating member.

A toggle-lever mechanism within the meaning of the present invention therefore has two levers which are connected in articulated fashion to one another and which are formed by the first and second actuating sections. Owing to a force acting on the articulated connection between the first and second actuating sections, the actuating member, i.e. the toggle lever, is stretched and, in the case of a greater increase in force, is moved. As a result, the detachment element is caused to be displaced towards the latching lug.

The latching lug and the corresponding latching element connect the plug-type connector and the opposing plug-type connector in the plugged-together state to one another in such a way that they cannot be separated from one another without the latching lug being unlocked. The term "locking and unlocking" is therefore understood to mean a connection between the plug-type connector and the opposing plug-type connector in the broadest sense. The latching lug and the latching element in this case form a stop, which prevents a plug-type connector from being withdrawn from the opposing plug-type connector.

With the aid of the actuating member forming a toggle-lever mechanism, a very compact detachment element which can be actuated with very little expenditure of force can be provided, which detachment element exerts sufficient force on the latching lug to unlock said latching lug when the actuating member is pressed.

It is particularly advantageous if the first actuating section of the actuating member is formed, as a spring-elastic section, integrally with the detachment element. In this case, the detachment element can be formed from a plastic, for example, wherein the first actuating section protrudes from the basic body of the detachment element in the form of a spring-elastic lug.

It is also conceivable for the first actuating section and the second actuating section of the actuating member to be formed integrally as a section of an elastic spring arm. The first and second actuating sections are therefore configured as regions of an elastic spring arm without any joints. The articulated connection of two lever arms which is required for the toggle-lever mechanism is in this case effected by the elasticity of the spring arm. The articulated joint of the toggle lever is in this case formed by the elastic connecting region between the end regions of the spring arm.

It is particularly advantageous if the spring-elastic section or the elastic spring arm exerts a restoring force on the detachment element, said restoring force being directed away from the latching lug of an opposing plug-type connector which is plugged onto the plug-type connector. This ensures that the detachment element always returns automatically to the initial position without any additional actuation or further restoring elements. The elasticity of the spring arm or of the spring-elastic section is in this way used not only for forming an articulated joint for the toggle lever, but also for restoring the detachment element to the initial position.

In one embodiment, the first actuating section of the actuating member can be connected in rotationally articulated fashion to the second actuating section of the actuating member. In this embodiment, a rotary joint between the first actuating section and the second actuating section is always provided. Such a rotary joint can be realized in the easiest way by virtue of the fact that the first actuating section rests on the second actuating section, which is formed as a separate part therefrom, and is connected in rotationally articulated fashion via a film hinge or by latching in a pivot bearing, for example.

The connection between the second actuating section of the actuating member and the plug-type connector which is required for the toggle-lever mechanism can in one embodiment be realized by virtue of the fact that the plug-type connector has a stop. The second actuating section of the actuating member and the stop are in this case oriented towards one another in such a way that the free end of the second actuating section is supported on the stop in the event of the action of a force on the actuating member and the detachment element is displaced so as to unlock the latching lug. The second actuating section of the actuating member is therefore not fixedly connected to the plug-type connector, for example via a joint, but only interacts with the plug-type connector in the event of the action of a force on the actuating member by virtue of the fact that the free end of the second actuating section hits the stop and the actuating member is in this way supported on the plug-type connector.

It is particularly advantageous if a raised tab protrudes from the insulating housing, spaced apart from the stop. The tab then, together with the stop, delimits an interspace, into which the free end of the second actuating section enters. The second actuating section in this case rests on the free end of the tab, which protrudes from the insulating housing on the same side as the stop. Therefore, the second actuating section is held in the interspace and the detachment element is positioned, in the unplugged state of the plug-type connector, on the plug-type connector in a largely fixed position. A movement of the detachment element on the plug-type connector housing is therefore suppressed and it is ensured that the end of the detachment element always returns to the same position after the unlocking process.

In another embodiment, next to the stop, i.e. adjacent to or adjoining the stop, a depression is provided in the insulating housing, with the free end of the second actuating section entering said depression. This also means that the detachment element in the unplugged state of the plug-type connector is positioned on the plug-type connector in a preset fixed position.

As an alternative to this, however, it is also conceivable for the second actuating section of the actuating member to be connected to the plug-type connector. The second actuating section can in this case be formed, for example, integrally from the plastic material of the insulating housing of the plug-type connector and protrude from the insulating housing. The articulated joint between the second actuating section and the plug-type connector which is required for the toggle-lever mechanism can be provided either via a film hinge connection or via the spring elasticity of the second actuating section.

The displaceable mounting of the detachment element on the plug-type connector preferably succeeds by virtue of the fact that the plug-type connector has guide elements, such as, for example, profiled guide rails, on which the detachment element with a guide profile matched thereto is mounted linearly displaceably. These guide elements can be, for example, L-shaped guide webs, i.e. webs protruding from the outer surface of the insulating housing of the plug-type connector and having a projecting guide shoulder. Then, there would be provided on the inner walls of the detachment element shoulders interacting therewith, which shoulders engage beneath the guide shoulders.

It is particularly advantageous if in each case one detachment element is mounted displaceably on the mutually opposite side faces of the insulating housing of the plug-type connector. Thus, the plug-type connector and the opposing plug-type connector are connected to one another on both sides in the plugged-together state and can be unlocked with one hand by engaging over the plug-type connector and applying pressure on the respective actuating members towards one another.

The detachment element preferably has an unlocking contour, which tapers towards the free end of the detachment element, on its side facing the latching lug of the opposing plug-type connector. In the event of a displacement of the detachment element, the detachment element can be guided with this wedge-shaped unlocking contour between the latching lug and the insulating housing of the plug-type connector.

The invention will be explained in more detail below with reference to exemplary embodiments having the attached drawings, in which.

Figure 22:
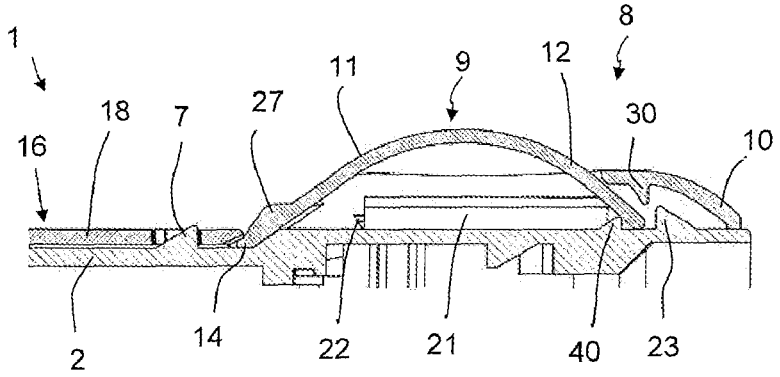
Figure 22:
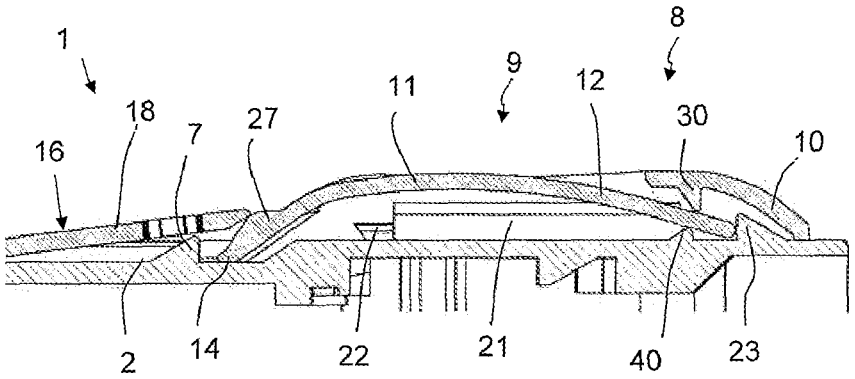
Figure 23:
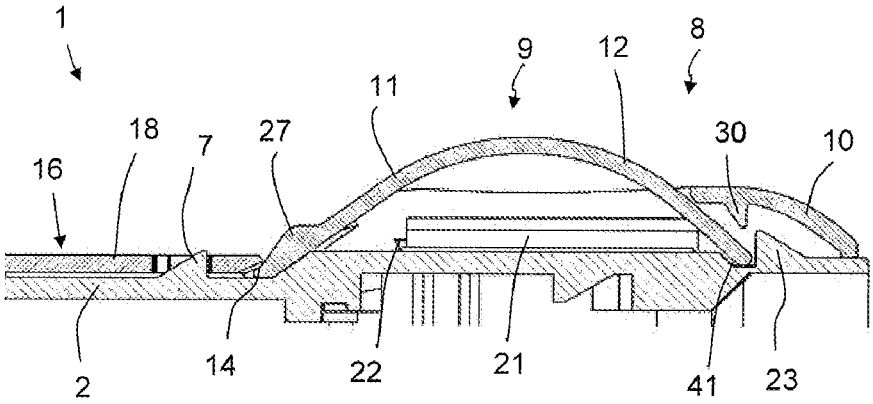
Figure 23:
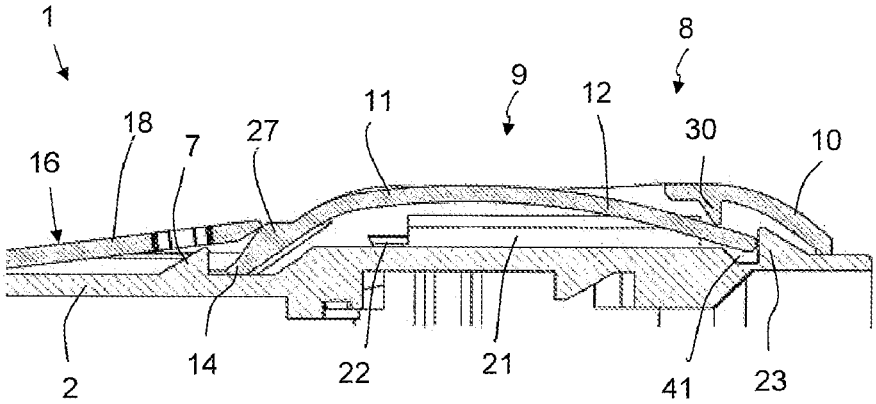
Figure 24:
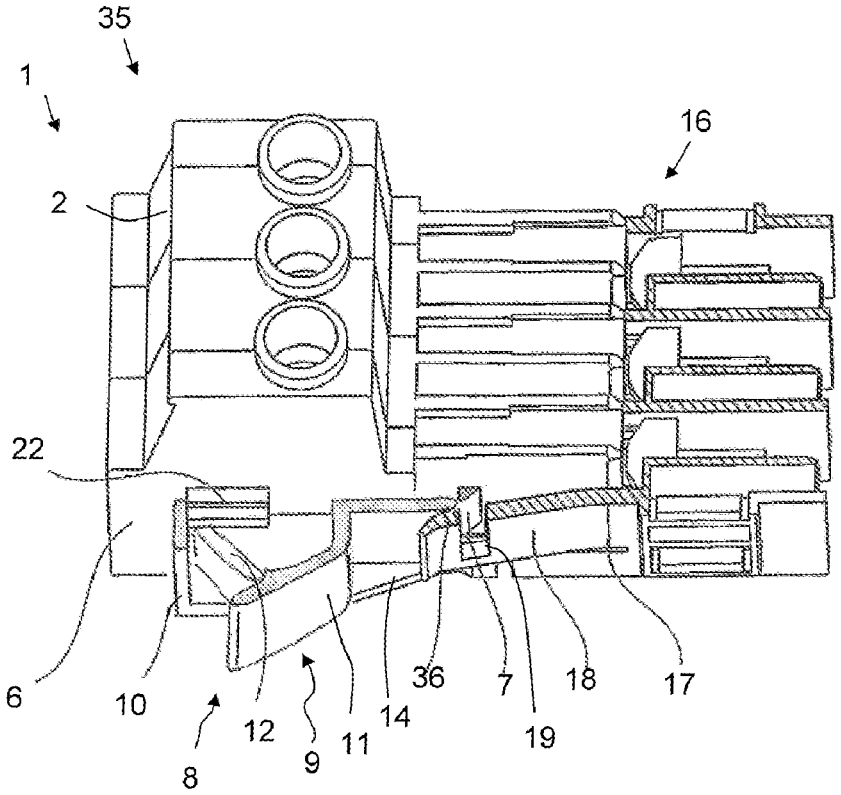

FIG. 22*a* shows a side sectional view through a plug-type connector arrangement comprising a tab on the plug-type connector in the locked state;

FIG. 22*b* shows a side sectional view through the plug-type connector arrangement shown in FIG. 22*a* in the unlocked state;

FIG. 23*a* shows a side sectional view through a modified embodiment of a plug-type connector arrangement comprising a depression in the plug-type connector in the locked state;

FIG. 23*b* shows a side sectional view through the plug-type connector arrangement shown in FIG. 23*a* in the unlocked state;

FIG. 24 shows a perspective view of a second embodiment of a plug-type connector arrangement.

Figure 1:
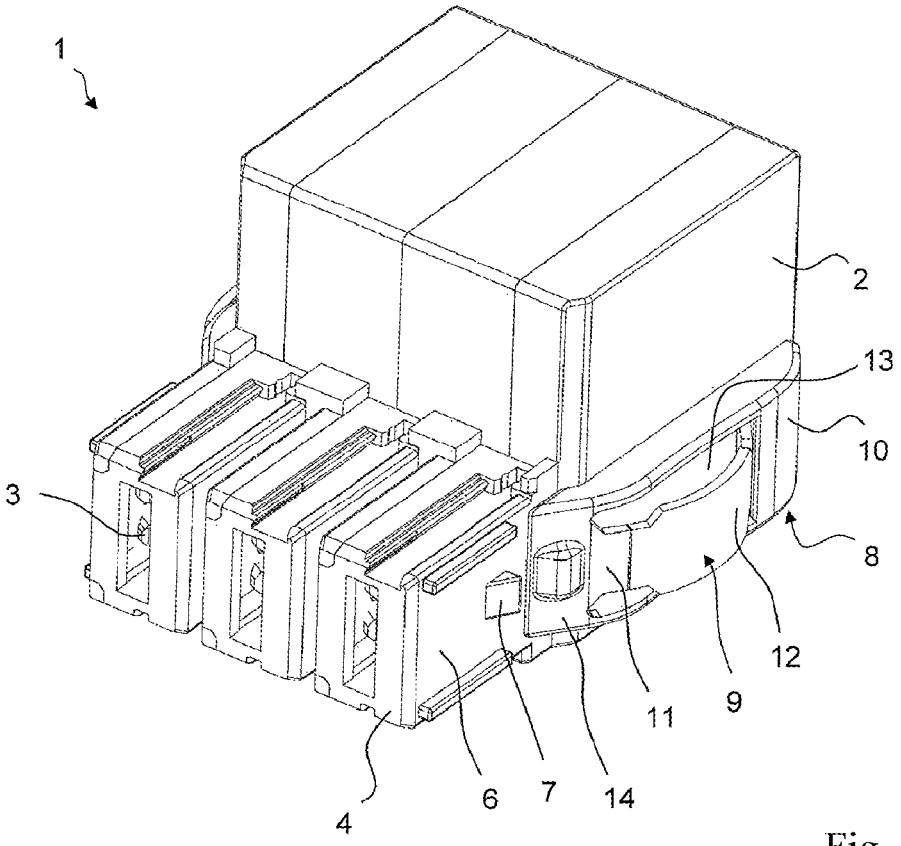
FIG. 1 shows a perspective view of a plug-type connector comprising detachment elements arranged displaceably thereon.

FIG. 1 shows a perspective view of a plug-type connector 1 comprising an insulating housing 2, in which plug-type contacts 3 are installed. The plug-type contacts 3 are accessible via contoured plug-type sleeves 4 on the front side of the insulating housing 2 in order to come into electrically conductive contact with corresponding plug-type contacts of an opposing plug-type connector plugged onto the plug-type connector 1 on the front side.

In the exemplary embodiment illustrated, contact can be made with the plug-type contacts 3 in each case through conductor insertion openings (not shown) in the rear side using assigned electrical conductors. For this purpose, spring-loaded terminals which are provided for making terminal connections with an electrical conductor are installed in the interior of the insulating housing.

Within the scope of the present invention, other embodiments of plug-type connectors are of course also conceivable.

In order to now enable a connection of an opposing plug-type connector (not illustrated) plugged onto the plug-type connector 1 to the plug-type connector 1 and in order to prevent the opposing plug-type connector from being removed from the plug-type connector 1 in an undesired manner, in each case one latching element 7 in the form of a projecting latching tab is provided on the mutually opposite side walls 6 of the insulating housing 2. These latching elements 7 each interact with an assigned latching lug of an opposing plug-type connector (not illustrated). In this case, a latching lug engages behind the projecting latching element 7, which acts as stop for the latching lug and prevents a positioned opposing plug-type connector from being removed from the plug-type connector 1 in an undesired manner.

As a result, the opposing plug-type connector is "latched" on the plug-type connector 1 in the broadest sense, i.e. is prevented from being removed in an undesired manner.

In order to cancel this locking, in each case one detachment element 8 is mounted displaceably on each of the two side walls 6 of the (multi-part in the exemplary embodiment illustrated) insulating housing 2. These detachment elements 8 each have an actuating member 9, which is formed integrally with the basic body 10 of the detachment element 8, for example from plastic in an injection-molding process, in the exemplary embodiment illustrated. "Integrally" is preferably understood to mean the formation without any joints from the same material in one part.

The actuating member 9 in the exemplary embodiment illustrated is in the form of an integral elastic spring arm, which is connected with a first actuating section 11 to the basic body 10 of the detachment element 8. For this purpose, the spring arm extends starting from the first actuating section 11, from the basic body and is formed integrally therewith. After a bend, a second actuating section 12 adjoins this first actuating section 11, the free end region of said second actuating section entering an opening in the basic body 10. The free end of the second actuating section 12 then bears against the insulating housing 2, at least when a force directed in the direction of the insulating housing is exerted on the actuating member 9.

A toggle-lever mechanism is provided by this from the first and second actuating sections 11, 12, for example at least by the actuating member 9 in the form of an elastic spring arm. The first and second actuating sections 11, 12 in this case represent the end regions of the elastic spring arm, which are connected movably to one another owing to the elasticity of the spring arm. Owing to a force directed on the actuating member 9 in the direction of the insulating housing, which force can be exerted by a person's finger, for example, the detachment element 8 is displaced in the direction of the latching element 7 since then the second actuating section 12 is supported on a stop (not illustrated) on the insulating housing 2. The actuating force directed towards the insulating housing 2 is in this case converted, in intensified form, into a linear movement of the detachment element 8 in accordance with the principle of a toggle-lever mechanism.

It can be seen that the basic body 10 of the detachment element 8 tapers (conically) on its side facing the latching element 7. This tapered end 14 can then be guided between the side wall 6 of the insulating housing 2 and a latching lug (not illustrated) which engages over the latching element 7. Then, in the event of a displacement of the detachment element 8 in the direction of the latching element 7, the latching lug is lifted by the wedge shape and unlocked from the latching element 7.

Figure 2:
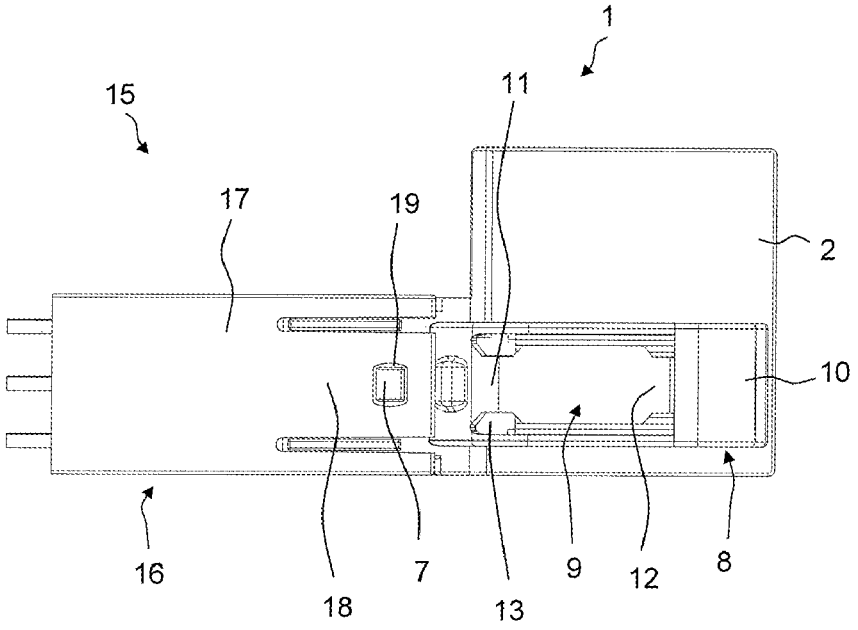
FIG. 2 shows a side view of a plug-type connector arrangement comprising a plug-type connector and an opposing plug-type connector and a detachment element on the plug-type connector.

FIG. 2 shows a side view of a plug-type connector arrangement 15 comprising the above-described plug-type connector 1 and an opposing plug-type connector 16 plugged onto the plug-type connector 1. "Plugged onto" is also understood to mean plugged into, since it is irrelevant whether the insulating housing of the opposing plug-type connector surrounds the insulating housing 2 of the plug-type connector 1 or enters an opening in the insulating housing 2 of the plug-type connector 1. Therefore, plugging onto should be understood in the sense that the opposing plug-type connector 16 and the plug-type connector 1 engage one inside the other in such a way that the mutually assigned plug-type contacts 3 enter into engagement with one another and an electrically conductive connection between the corresponding plug-type contacts 3 of the plug-type connector 1 and the opposing plug-type connector 16 is produced. In this plug-in state, an elastic latching lug 18 formed on the insulating housing 17 of the opposing plug-type connector 16 latches with the assigned latching element 7 of the plug-type connector. In the exemplary embodiment illustrated, this latching (locking) takes place by virtue of the fact that the latching element 7, which is in the form of a latching tab, enters a latching opening 19 in the latching lug 18 and a stop is thus formed. However, a different type of locking is also conceivable, for example by virtue of the latching lug 18 having a protruding latching tab, which enters an assigned latching opening (for example latching hollow) in the side wall 6 of the insulating housing 2 of the plug-type connector 1. In the plug-in position illustrated, the detachment element 8 is displaced away from the latching element 7 and the latching lug 18 in the direction of the rear side of the plug-type connector 1 with the aid of the spring elasticity of the actuating member 9 and possibly also assisted by a force exerted by the latching lug 18 on the detachment element 8.

Figure 3:
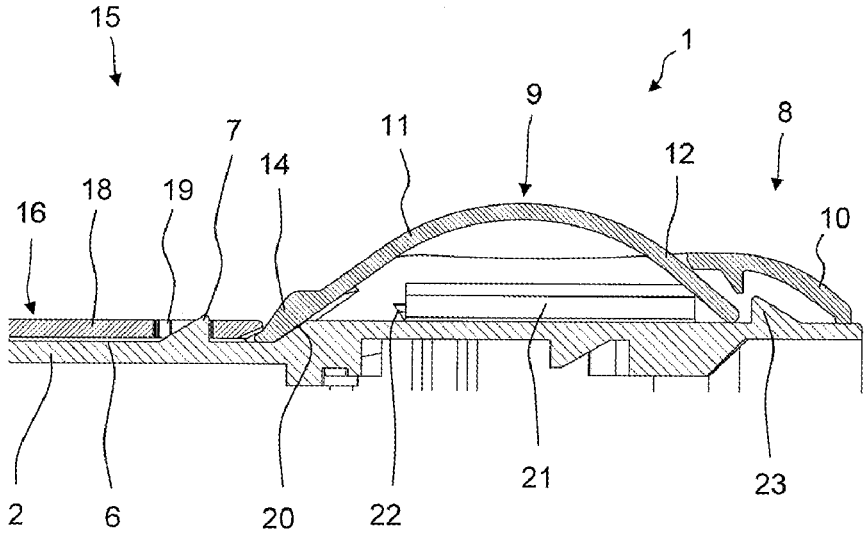
FIG. 3 shows a side sectional view, in plan view, of the plug-type connector arrangement shown in FIG. 2 in the locked state.

FIG. 3 shows a side sectional view of the plug-type connector arrangement 15 shown in FIG. 2 in the plug-in state. It is shown that the latching lug 18 rests flush on the side wall 6 of the insulating housing 2 of the plug-type connector 1 and the latching element 7 (latching tab) enters the latching opening 19 in the latching lug 18. The actuating end 14 of the detachment element 8 which tapers in the form of a wedge adjoins the free end of the latching lug 18. The elastic actuating member 9 and the elastic latching lug 18 exert such a force in the plug-in position on the detachment element 8 that the detachment element 8 is displaced away from the latching lug 18 up to a sloping surface 20 on the side wall 6 of the insulating housing 2 parallel to the surface of the side wall 6. This linear displacement is enabled by virtue of the fact that guide elements 21 in the form of profile rails protrude on the side wall 6 of the insulating housing 2 of the plug-type connector 1, said guide elements interacting with a corresponding guide profile 22 on the inner walls of the basic body 10 of the detachment element 8. The guide profile 22 is in this case in the form of a guide shoulder extending parallel to the surface of the side wall 6, which guide shoulder engages beneath a projecting guide shoulder of the guide profile 21 of the plug-type connector 1. Thus, a rail guide of the detachment element 8 parallel to the surface of the insulating housing 2 is provided.

It can furthermore be seen that, in the rearward region away from the latching element 7, a projecting stop 23 is provided for the free end of the second actuating section 12 of the actuating member 9. In the plug-in position illustrated, the free end of the second actuating section 12 does not bear against this stop.

Figure 4:
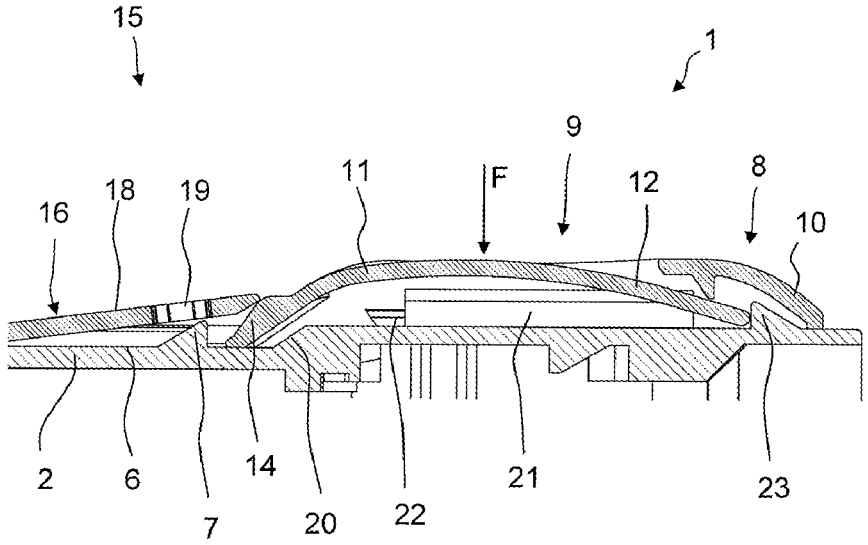
FIG. 4 shows a side sectional view, in plan view, of the plug-type connector arrangement shown in FIG. 2 in the unlocked state.

FIG. 4 shows a side sectional view of the plug-type connector arrangement 15 shown in FIG. 2, but now in the state of unlocking of the latching tab 18. It is shown that the second actuating section 12 now migrates towards the stop 23 and hits said stop as a result of an actuating force F being exerted in the elastic central region, which almost forms an articulated joint for the toggle-lever mechanism, of the actuating member 9 in the direction of the side wall 6 of the insulating housing 2 of the plug-type connector 1. As a result, the detachment element is displaced in the direction of the latching element 7 by virtue of the actuating force F being converted by the articulated connection of the first actuating section 11 and the second actuating section 12 into an intensified linear displacement force. The wedge-shaped actuating end 14 of the basic body 10 moves below the free end of the latching lug 18 and lifts the latching lug 18 away from the insulating housing 2. The wedge-shaped actuating end 14 of the detachment element 8 in this case rests with its free end on the side wall 6 of the insulating housing 2. The latching element 7 thus comes out of engagement with the latching opening 19 in the latching lug 18, with the result that the stop formed by the latching lug 18 is cancelled and the plug-type connection is unlocked. The opposing plug-type connector 16 can then be removed easily from the plug-type connector 1.

Figure 5:
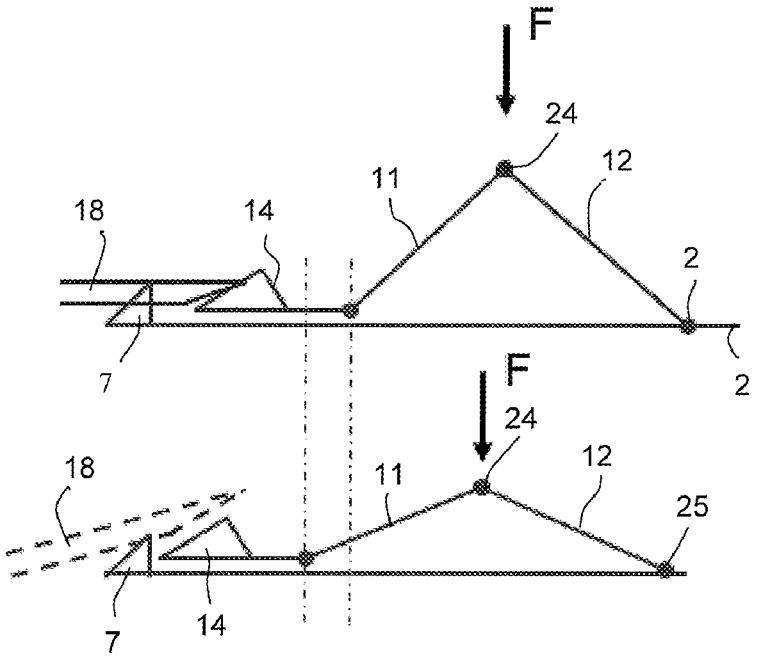
FIG. 5 shows a functional sketch of the toggle-lever mechanism for the detachment element.

FIG. 5 shows a schematic sketch of the toggle-lever mechanism provided by the first and second actuating sections 11, 12 of the actuating member 9. The first and second actuating sections 11, 12 are in this case connected to one another by means of an articulated joint 24. That end of the second actuating section 12 which is opposite the articulated joint 24 is connected by means of a rotational articulated joint (pivotably) to the insulating housing 2 at a connection point 25, at least during actuation of the toggle-lever mechanism. This connection point 25 can be provided, for example, by the above-described stop 23 without a fixed connection between the second actuating section 12 and the insulating housing 2 being necessary.

That end of the first actuating section 11 which is opposite the articulated joint 24 is connected to the actuating end 14 of the detachment element which tapers in the form of a wedge.

By virtue of the action of an actuating force F in the direction of the insulating housing 2, the actuating end 14 which tapers in the form of a wedge moves in the direction of the latching element 7 (latching tab) in order to lift off and unlock the latching tab 18 of the opposing plug-type connector 16 plugged thereon. In this case, the force is converted with the aid of the two lever arms (first and second actuating sections 11, 12), which are connected to one another in articulated fashion, into an intensified unlocking force acting linearly in the direction of the latching element 7, parallel to the surface of the insulating housing 2.

Figure 6:
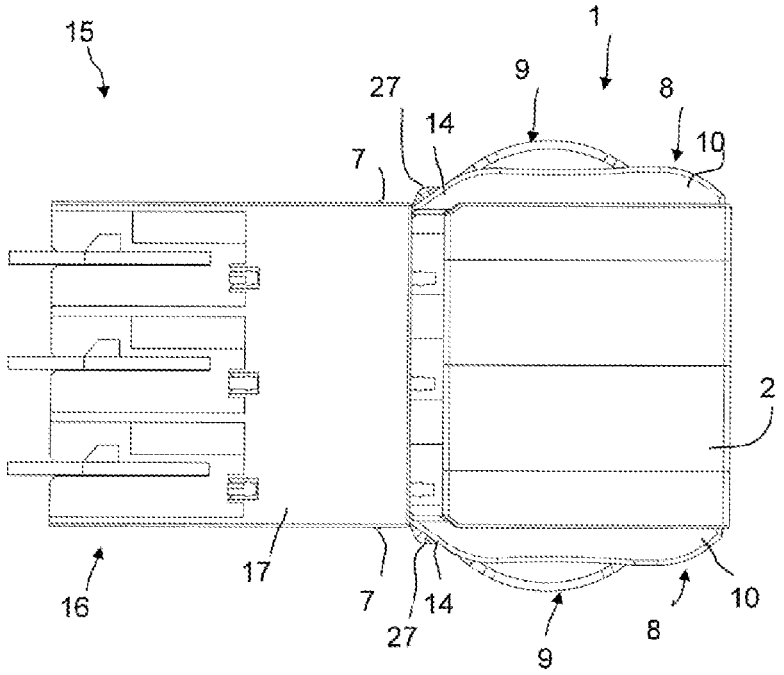
FIG. 6 shows a plan view of the plug-type connector arrangement shown in FIG. 2 in the locked state.

FIG. 6 shows a plan view of the plug-type connector arrangement 15 shown in FIG. 2. It can be seen that the opposing plug-type connector 16 has been plugged onto the plug-type connector 1. The latching lugs in this case lie flush with respect to the outer wall of the insulating housing 17 of the opposing plug-type connector 16 and are therefore not visible. However, it can be seen that the free ends of the latching elements of the plug-type connector 1, which are in the form of latching tabs, protrude out of the contour of the opposing plug-type connector 16 since they enter the latching opening 19 in the assigned latching lugs 18 of the opposing plug-type connector 16.

Furthermore, it can be seen that a projecting actuating tab 27 is provided on a wedge-shaped actuating end 14 of the detachment element 8. This upright actuating tab 27, which is bent back to a greater extent, makes it possible for the latching lug 18 to be lifted off to a sufficient extent in the case of a relatively small displacement of the detachment element 8.

It can furthermore be seen that the actuating member 9 in the form of an elastic spring arm is curved in the plug-in position illustrated and protrudes out of the basic body 10 of the detachment element 8.

Figure 7:
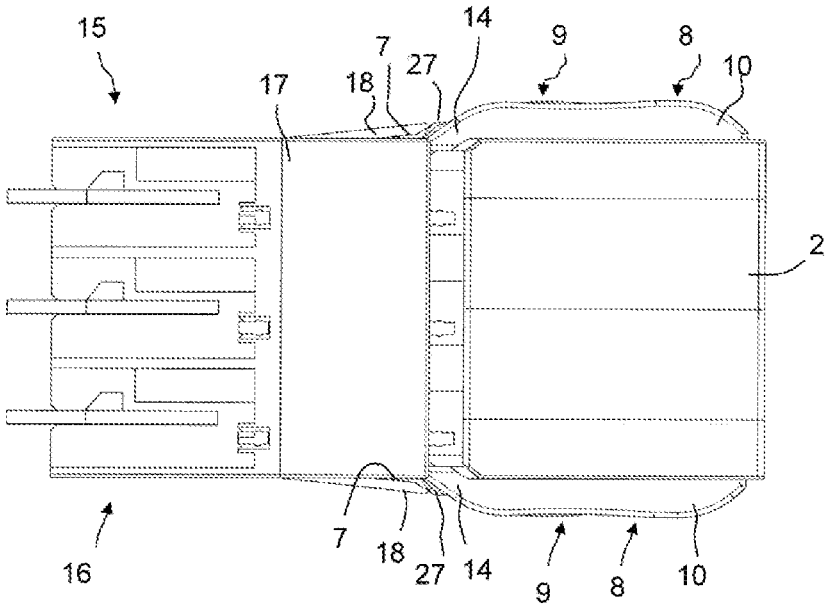
FIG. 7 shows a plan view of the plug-type connector arrangement shown in FIG. 2 in the unlocked state.

FIG. 7 shows a plan view of the plug-type connector arrangement 15 shown in FIGS. 2 and 6 in the unlocked state shown in FIG. 4. It can be seen that the previously curved actuating member 9 has now been pressed in the direction of the basic body 10 of the detachment element 8 and the adjoining insulating housing 2 of the plug-type connector 1. In this case, the detachment element 8 is displaced slightly in the direction of the latching element 7 or the opposing plug-type connector 16. In this case, the free end of the latching lug 18 slides on the wedge-shaped actuating end 14 and the actuating projection 27 thereof and is pivoted away from the latching element 7 for unlocking. This is enabled by sufficient elasticity of the latching lug 18. In this case, the latching lug 18 is preferably manufactured so as to be integral with the insulating housing 17 of the opposing plug-type connector in one piece.

Figure 8:
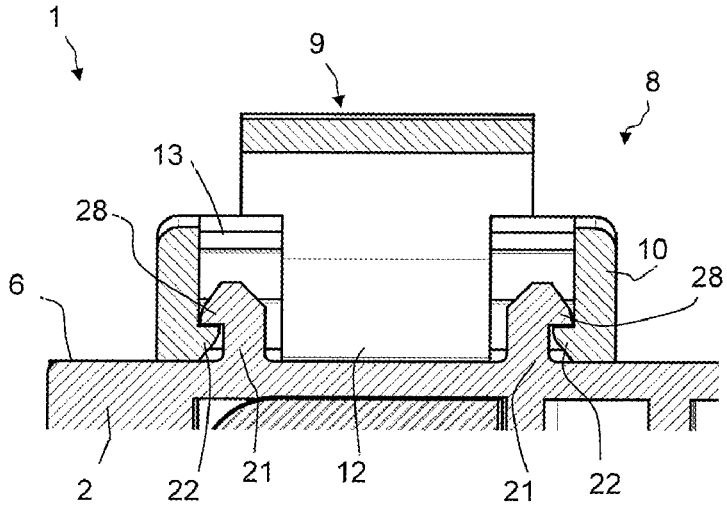
FIG. 8 shows a sectional view through the plug-type connector with the detachment element arranged displaceably thereon.

FIG. 8 shows a sectional view through the detachment element 8 which is guided linearly displaceably on the insulating housing 2 of the plug-type connector 1. It can be seen that guide profiles 22 protrude on the inner wall of the basic body 10 of the detachment element 8 adjacent to the insulating housing 2 and engage beneath assigned guide shoulders 28 of the guide elements 21 (profile rails) in order to thus mount the detachment element 8 linearly displaceably on the insulating housing 2 of the plug-type connector 1.

It can also be seen that the actuating member 9 in the form of an elastic spring arm protrudes out of the opening 13 in the basic body 10 of the detachment element 8 and rests with the free end of the second actuating section 12 on the insulating housing 2.

Figure 9:
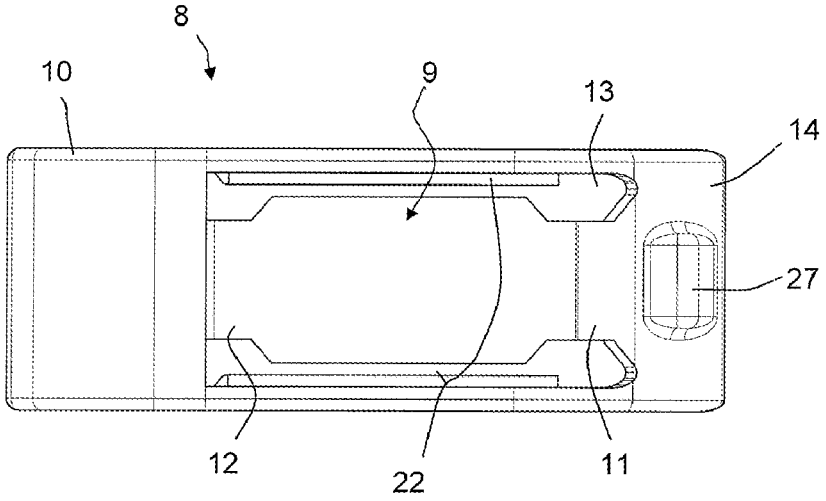
FIG. 9 shows a plan view of the detachment element for the plug-type connector arrangement shown in FIGS. 1 to 8.

FIG. 9 shows a plan view of the detachment element of the above-described exemplary embodiment. In this case, it can be seen that the actuating member 9 is in the form of an elastic spring arm, which is produced integrally with the basic body 10 from plastic using injection molding, protrudes from the basic body 10 and is released from the basic body 10 through the opening 13. The spring arm is widened in the central region, which connects the first actuating section 11 and the second actuating section 12 to one another, in order to thus provide a larger area for the actuation by a user's finger.

It can also be seen that guide profiles 22 in the form of webs protrude from the inner wall of the basic body 10 and extend parallel to the base plane of the detachment element 8.

Figure 10:
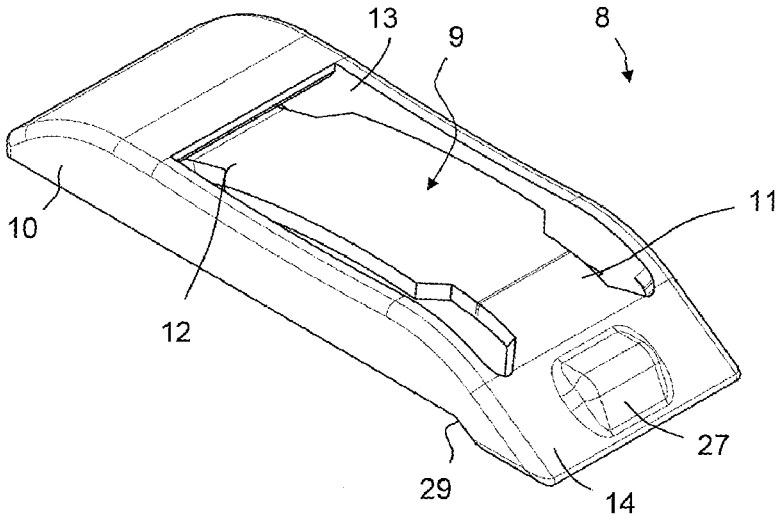
FIG. 10 shows a perspective view of the detachment element shown in FIG. 9.

FIG. 10 shows a perspective view of the detachment element 8 in the actuated state, in which the actuating member 9 is pressed in the direction of the insulating housing 2 of the plug-type connector 1 (not illustrated). It can be seen that the second actuating section 12 passes through the opening 13 in the basic body 10.

It can also be seen that, on the lower side, the wedge-shaped actuating end in a sloping surface 29, which is matched to the sloping surface 20 of the insulating housing 2 (cf. FIGS. 3 and 4), merges with a vertically offset resting plane.

Figure 11:
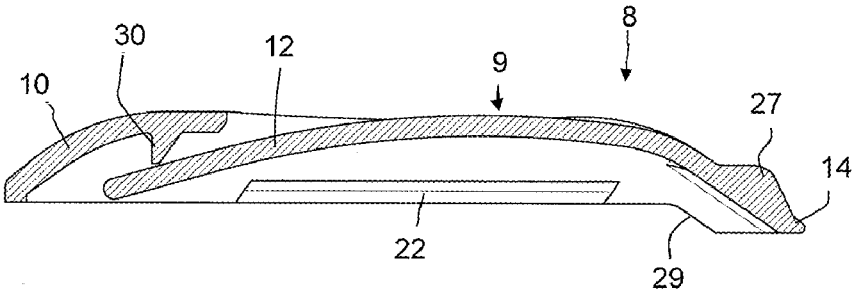
FIG. 11 shows a side sectional view of the detachment element shown in FIG. 10.

It can be seen from the side sectional view shown in FIG. 11 that the free end of the second actuating section 12 ends on the vertically offset plane of the lower side of the basic body 10 in order to rest on the adjoining insulating housing 2 (not illustrated) of the plug-type connector 1. For this purpose, the second actuating section 12 is passed through a protruding guide finger 30 between the second actuating section 12 and the basic body 10 in the direction of the plane of the basic body 10 which is open at the bottom.

Figure 12:
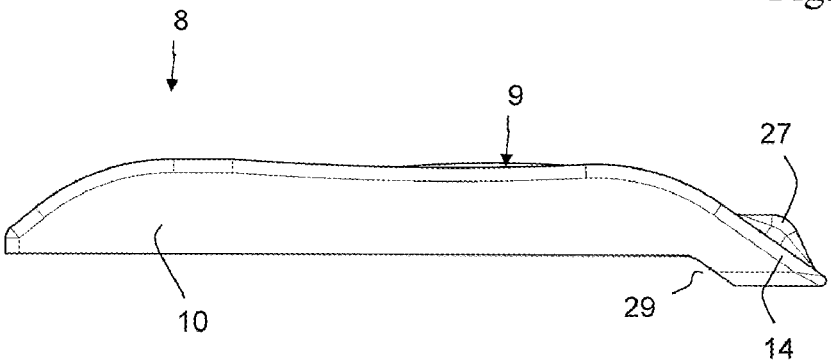
FIG. 12 shows a side view of the detachment element shown in FIGS. 10 and 11.

FIG. 12 shows a side view of the detachment element 8. It can be seen that the basic body 10 is closed off by side walls. It can also be seen that the lower plane is divided into two vertically offset shoulders by the sloping surface 29.

Figure 13:
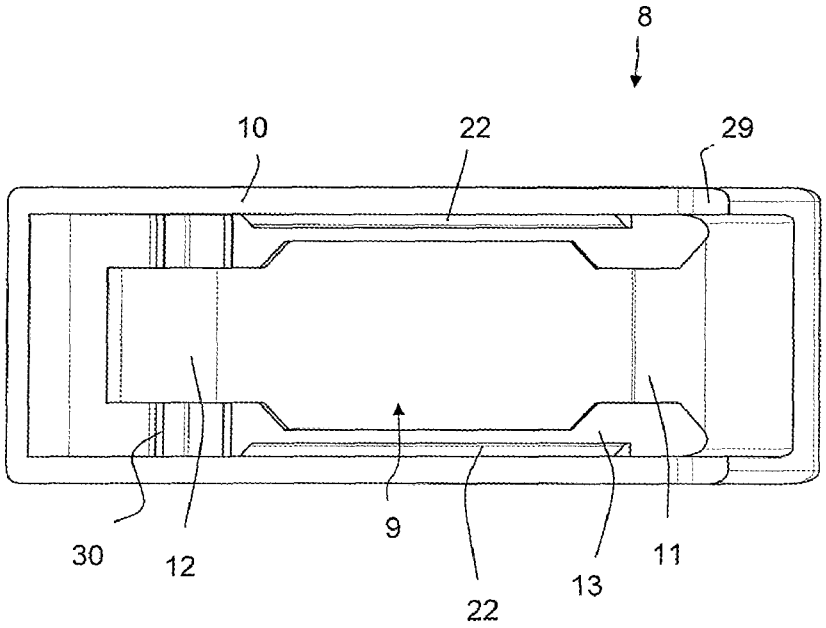
FIG. 13 shows a view of the lower side of the detachment element shown in FIGS. 9 to 12.

FIG. 13 shows a view of the lower side of the detachment element 8. It can be seen here that the second actuating section 12 passes through the opening 13 in the basic body 10. It can also be seen that the first actuating section 11 forms part of the basic body 10 and protrudes from the upper side of the basic body 10, which is rectangular per se, in the form of an elastic spring arm. The second actuating section 12 is the free end region of this elastic spring arm, which is formed integrally, i.e. without any joints, with the basic body 10, preferably from plastic material using injection molding.

Figure 14:
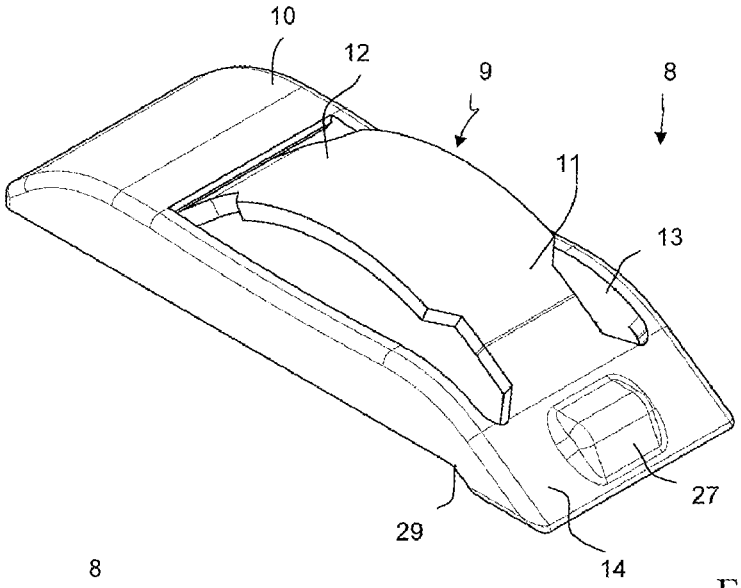
FIG. 14 shows a plan view of the detachment element in the unactuated state in which it is fitted on a plug-type connector (not illustrated)

FIG. 14 shows a plan view of the detachment element 8 in the unactuated state, in which the detachment element 8 is actually fitted on a plug-type connector (not illustrated). It can be seen, in comparison with the state in FIG. 10, that the actuating member 9 now protrudes with a curvature out of the opening 13 in the basic body 10 and protrudes beyond the plane spanned by the opening 13. The free end of the actuating member 9 in the form of a spring arm, i.e. the second actuating section 12, is in this case displaced further in the direction of the first actuating section 11, in comparison with the situation in FIG. 10. This results in curvature in the elastic connecting region between the first and second actuating section 11, 12 and in the deformation illustrated.

Figure 15:
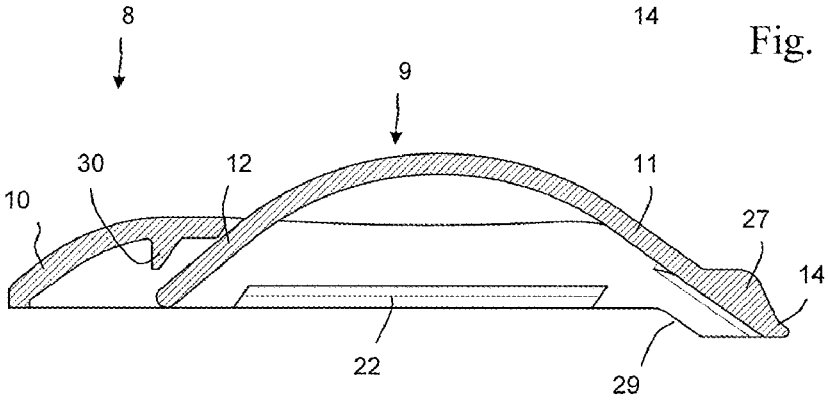
FIG. 15 shows a side sectional view through the detachment element shown in FIG. 14.

FIG. 15 shows a side sectional view of the detachment element 8 shown in FIG. 14. Said figure shows even more clearly that the second actuating section 12 is displaced further in the direction of the first actuating section 11 in comparison with FIG. 11. In this case, in the exemplary embodiment illustrated, the free end of the second actuating section 12 moves approximately at the level below the protruding guide finger 30 of the basic body 10, which points in the direction of the second actuating section 12.

Figure 16:
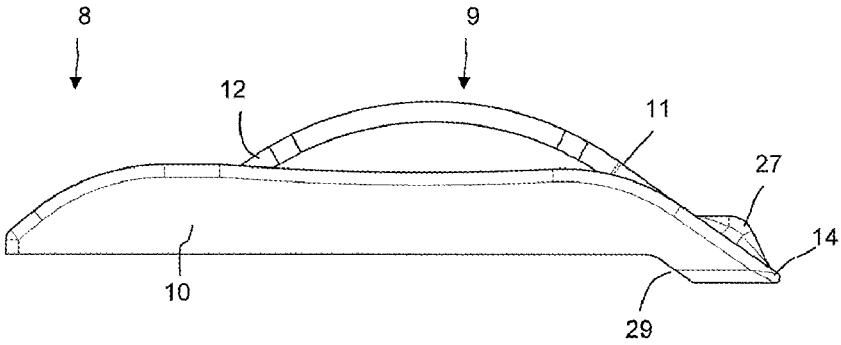
FIG. 16 shows a side view of the detachment element shown in FIGS. 14 and 15.

FIG. 16 shows a side view of the detachment element 8 shown in FIGS. 14 and 15. In this case, it can once again be seen that the actuating member 9 is curved in the unactuated position in which it is fitted on a plug-type connector, as illustrated, and protrudes with its curvature out of the upper side of the basic body 10, which is defined by the plane spanned by the opening 13 in the upper side of the basic body 10. Thus, the detachment element 8 can be actuated easily by hand in the region of the curvature of the actuating member 9, which curvature protrudes out of the basic body 10, by virtue of a finger exerting pressure on this curved, elastic part of the actuating member 9. This curvature of the actuating member 9 is achieved by virtue of the fact that the free end of the second actuating section 12 rests on a plug-type connector on the lower side of the basic body 10, which is opposite the curved section of the actuating member 9, which connects the first and second actuating sections 11, 12. The elastic actuating member 9 is thus moved into this curved position owing to its spring elasticity. This is also achieved by virtue of the fact that the integral connection of the first actuating section 11 to the basic body 10 forms a spring element.

Figure 17:
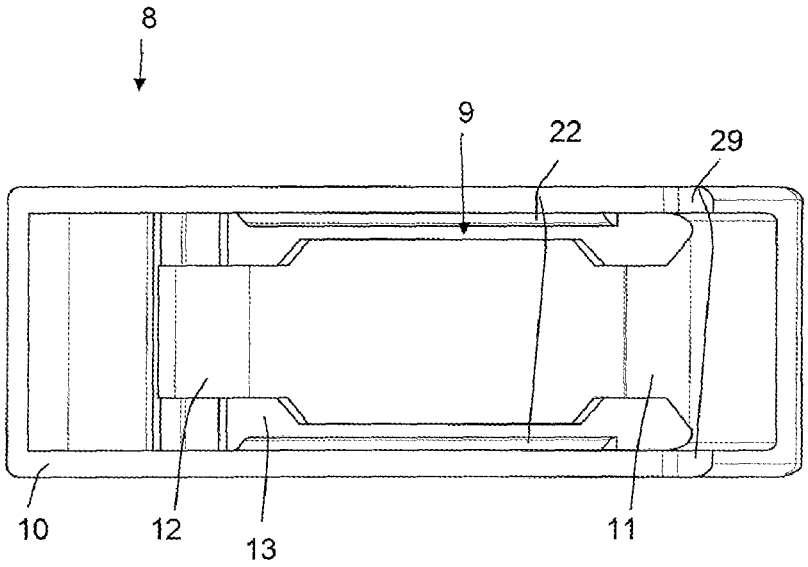
FIG. 17 shows a view of the lower side of the detachment element shown in FIGS. 14 to 16.

FIG. 17 shows a view of the lower side of the detachment element 8 shown in FIGS. 14 to 16. In this case, in comparison with the illustration shown in FIG. 13, it can be seen that the second actuating section 12 and in particular the free end of the second actuating section 12 is moved further in the direction of the first actuating section 11. The length of the actuating member 9, which can be seen in this view of the lower side of the detachment element 8, is therefore shortened in comparison with the actuated state of the actuating member 9 (FIG. 13). This results in the curvature of the actuating member 9 which can be seen in FIGS. 14 to 16.

Figure 18:
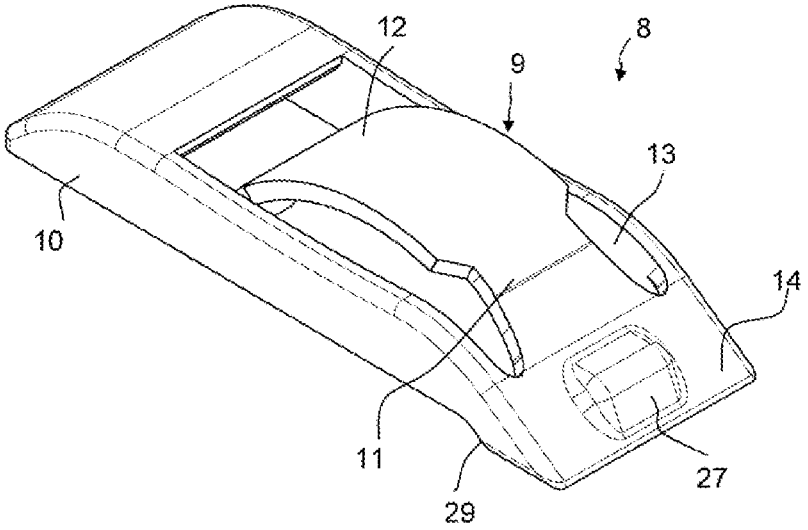
FIG. 18 shows a perspective view of the detachment element in the unfitted state.

FIG. 18 shows a perspective view of the detachment element 8 in the unfitted state. In this case, the lower side of the basic body 10 is free, with the result that the free end of the actuating member 9, i.e. the second actuating section 12 protrudes out of the plane of the basic body 10 on the lower side.

Figure 19:
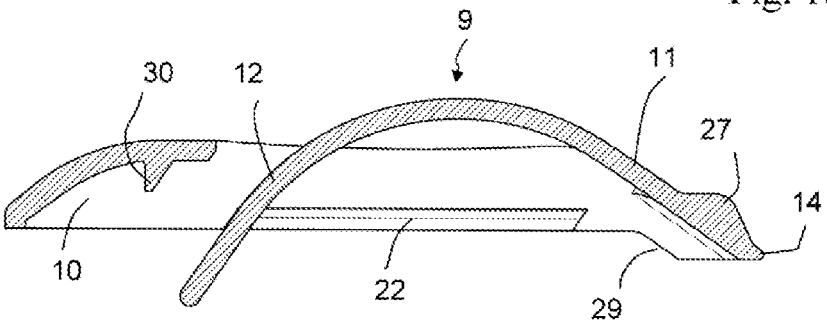
FIG. 19 shows a side sectional view through the detachment element shown in FIG. 18.
Figure 20:
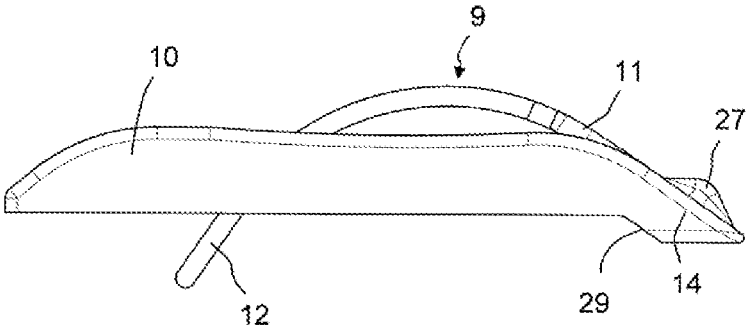
FIG. 20 shows a side view of the detachment element shown in FIGS. 18 and 19.

This is shown more clearly in the side sectional view of the detachment element 8 in FIG. 19 and the side view in FIG. 20. It can be seen that the actuating member 9 in this unactuated state is curved at least in the region of the connection between the first and second actuating sections 11, 12. The spring-elastic actuating member 9 therefore in this unactuated state assumes a contour in which the first actuating section 11 initially extends approximately in a straight line as an extension of the adjoining wall section of the basic body 10, which forms the tapered end 14. This is adjoined by a curved connecting section, which protrudes beyond the plane on the upper side of the basic body 10 and which then merges with the second actuating section 12. The free end region of the second actuating section 12 in this case again extends in a straight line out of the lower plane of the basic body 10 and protrudes out of the lower plane of the basic body 10.

Figure 21:
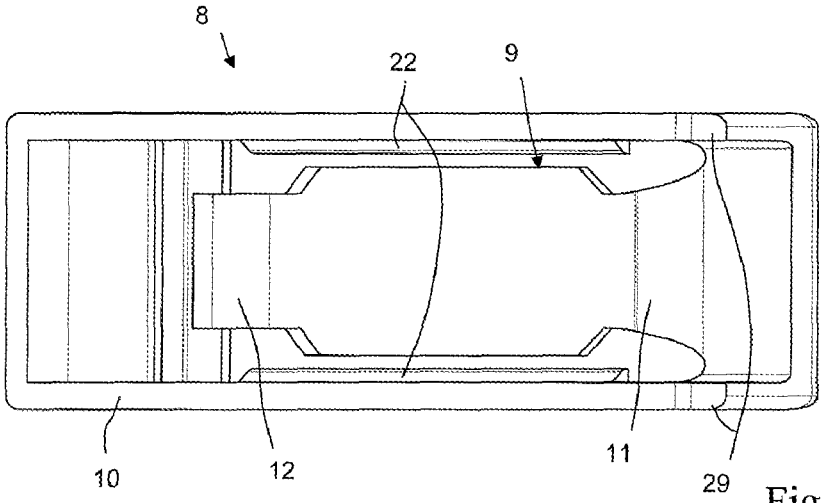
FIG. 21 shows a view of the lower side of the detachment element shown in FIGS. 18 to 20 in the unfitted state.

FIG. 21 shows a view of the lower side of the detachment element 8 shown in FIGS. 18 to 20. It can be seen here that the free end of the second actuating section 12 is moved further towards the first actuating section 11 in comparison with the state in which the detachment element 8 is fitted on a plug-type connector, firstly in the unactuated state shown in FIG. 17 and secondly in the actuated state shown in FIG. 13. The length of the actuating member 9 which can be seen in the plan view of the lower side of the actuating member 9 is therefore shortened further still with respect to the states or positions shown in FIGS. 13 and 17.

FIG. 22*a* shows a side sectional view of a modified embodiment of a plug-type connector arrangement 1 comprising a detachment element 8 arranged thereon. The insulating housing 2 of the plug-type connector 1 has a tab 40, which is spaced apart from the stop 23 and protrudes from the upper side of the insulating housing 2 on the same upper side as the stop 23, so as to form an interspace. The free end of the second actuating section 12 of the detachment element 8 protrudes into this interspace, which is delimited by the additional tab 40 and the stop 23.

In the locking state illustrated, the latching lug 18 of the opposing plug-type connector 16 rests on the insulating housing 2 and is latched with the latching element 7. The actuating member 9 is bent upwards. This is comparable with the embodiment shown in FIG. 3 without the additional tab 40. It can be seen that, in this state, the free end of the tab 40 bears against the inner side of the second actuating section 12.

FIG. 22*b* shows the modified plug-type connector arrangement 15 comprising an additional tab 40 in the unlocked state. In this case, the actuating member 9 in the embodiment shown in FIG. 4 without the additional tab 40 is pressed in the direction of the insulating housing 2 and lifts off the latching lug 18. This is achieved by virtue of the fact that the basic body 10 migrates in the direction of the stop 23, with the result that the wedge-shaped actuating end 14 engages under the latching lug 18. In this case, the basic body 10, with the aid of the additional tab, is fixedly clamped on the second actuating section 12 in-between and is fixed in its position. This can be intensified by the optional additional guide finger 30, which protrudes downwards in the direction of the tab 40 from the basic body 10. The detachment element 8 is thus, in the unplugged state of the plug-type connector 1, positioned on the plug-type connector 1 in a largely fixed position. This means that the detachment element 8 is always in an identical position relatively on the plug-type connector housing 1. Therefore, slackening of the detachment element 8 on the insulating housing 2 of the plug-type connector 1 is suppressed. The actuating end 14 of the detachment element 8 always returns to the same position after the unlocking process.

FIG. 23*a* shows another embodiment of the plug-type connector 1, in which the detachment element 8 in the unplugged state of the plug-type connector 1 is likewise positioned in a largely fixed position on the plug-type connector. This is achieved by virtue of the fact that, in addition to the stop 23, a depression 41 is provided in the outer side of the insulating housing 2. An end of the second actuating section 12, which is extended with respect to the original embodiment shown in FIGS. 3 and 4, enters this depression 41.

FIG. 23*a* shows the detachment element 8 in the locked position. In this case, the basic body 10 is displaced downwards away from the stop 23.

FIG. 23*b* shows the unlocked position, in which the actuating end 24 engages with its actuating projection 27 underneath the latching lug 28 and comes out of latching engagement with the latching element 7. In this case, the second actuating section 12 with its end edge bears against the stop 23 and rests on the peripheral edge of the depression 41 on the side opposite the stop 23. In this way, the basic body 10 is fixed in its position by virtue of the basic body 10 being fixed in position (fixedly clamped) with the aid of the optional guide finger 30 by the second actuating section 12 which is fixedly clamped between the peripheral edge of the depression 41 and the guide finger 30.

FIG. 24 shows a second embodiment of a plug-type connector arrangement 35. Again the plug-type connector 1 is formed from a multi-part insulating housing 2 with conductor connection contacts installed therein. The opposing plug-type connector 16 in turn has, on at least one side, an elastic latching lug 18 having a latching opening 19, which interacts with a latching element 7 in the form of a protruding, wedge-shaped latching tab in order to fix the plug-type connector 1 on the opposing plug-type connector 16. The free end 36 of the latching lug 18 is preferably tapered conically and curved in such a way that the actuating end 14 of the basic body 10 of a detachment element 8 mounted displaceably on the plug-type connector 1 engages beneath the latching lug 18 and lifts it off and unlocks it from the latching element 7.

In contrast to the above-described first embodiment, the detachment element 8 does not have an integral actuating member, but a multi-part actuating member 9. This is formed from a first actuating section 11, which is in turn formed integrally, i.e. without any joints, with the basic body 10 and provides an actuating section, which protrudes in sloping fashion out of the plane of the basic body 10, in order for an actuating force to be applied by a user's finger. On the lower side of this first actuating section 11, which is opposite the side wall 6 of the plug-type connector 1 and points towards this side wall 6, the second actuating section 12 is in the form of a separate part, which is connected in rotationally articulated fashion to the first actuating section 11. This second actuating section 12 is supported on the side wall 6 of the insulating housing 2 of the plug-type connector 1 and can optionally be connected to the insulating housing 2, for example via a film hinge or another articulated joint.

In contrast to the first embodiment, the first and second actuating sections 11, 12 are not connected to one another via an elastic, curved section of the actuating member 9. Instead, the second actuating section 12 is relatively rigid and only the first actuating section 11 is formed in an elastic transition section, forming a rotary joint, to the basic body 10. The region of the first actuating section 11 which interacts with the second actuating section 12 is likewise relatively rigid. The toggle-lever mechanism is provided by the rotationally articulated connection of the first and second actuating sections in the support of the second actuating section 12 on the inner wall of the first actuating section 11. In the first embodiment, the articulated connection forming the toggle-lever mechanism is provided between the first and second actuating sections 11, 12 via the elastically curved connecting section between the first and second actuating sections 11, 12, on the other hand.

The invention claimed is:

1. A plug-type connector arrangement, comprising:

a plug-type connector including at least one latching element and guide elements;

an opposing plug-type connector including at least one latching lug, wherein the plug-type connector and the opposing plug-type connector each comprise an insulating housing and plug-type contact elements arranged in the insulating housing, the plug-type contact elements configured to plug together to make electrical contact with associated plug-type contact elements in the plugged-together state, wherein the at least one latching element is configured to interact with the at least one latching lug when in the plugged-together state so as to fasten the plug-type connector on the opposing plug-type connectors; and at least one detachment element displaceably arranged on the plug-type connector, the at least one detachment element operative to unlock the latching lug, wherein the at least one detachment element comprises a basic body and an actuating member, the basic body including an opening and the actuating member including a first actuating section connected to the basic body, and a second actuating section mounted movably relative to the first actuating section and operative to interact with the plug-type connector, wherein the first actuating section and the second actuating section form a toggle-lever mechanism for displacing the detachment element in the event of a force acting on the actuating member, and wherein the basic body member is mounted linearly displaceably on the guide elements, a free end region of said second actuating section entering the opening in the basic body.

2. The plug-type connector arrangement according to claim 1, wherein the first actuating section is formed, as a spring-elastic section, integrally with the detachment element.

3. The plug-type connector arrangement according to claim 1, wherein the first actuating section and the second actuating section of the actuating member are formed integrally as a section of an elastic spring arm.

4. The plug-type connector arrangement according to claim 2, wherein the spring-elastic section or the elastic spring arm are configured to exert a restoring force on the detachment element, said restoring force being directed away from the latching lug of an opposing plug-type connector which is plugged onto the plug-type connector.

5. The plug-type connector arrangement according to claim 1, wherein the first actuating section of the actuating member is connected in rotationally articulated fashion to the second actuating section of the actuating member.

6. A detachment element for a plug-type connector arrangement according to claim 1, wherein the detachment element comprises a basic body having an opening and an actuating member, the actuating member having a first actuating section connected to the basic body of the detachment element, and a second actuating section mounted movably relative to the first actuating section and interacts with the plug-type connector, wherein the first actuating section and the second actuating section form a toggle-lever mechanism for displacing the detachment element in the event of the action of force on the actuating member, wherein the plug-type connector has guide elements, the basic body is mounted linearly displaceably on the guide elements, a free end region of said second actuating section entering the opening in the basic body.

7. A plug-type connector arrangement, comprising:

a plug-type connector including at least one latching element;

an opposing plug-type connector including at least one latching lug, the plug-type connector and the opposing plug-type connector each comprising an insulating housing and plug-type contact elements arranged in the insulating housing the plug-type contact elements configured to plug together and make electrical contact with an associated plug-type contact element when in the plugged-together state, wherein the at least one latching element is configured to interact with the at least one latching lug when in the plugged-together state so as to fasten the plug-type connector on the opposing plug-type connector; and at least one detachment element operative to unlock the latching lug, the at least one detachment element arranged displaceably on the plug-type connector, the at least one detachment element including an actuating member having a first actuating section connected to the detachment element, and a second actuating section mounted movably relative to the first actuating section and operative to interact with the plug-type connector, and wherein the first actuating section and the second actuating section form a toggle-lever mechanism for displacing the detachment element in the event of the action of force on the actuating member, wherein the plug-type connector has a stop, and in that the second actuating section of the actuating member and the stop are oriented towards one another in such a way that the free end of the second actuating section is supported on the stop in the event of the action of a force on the actuating member and the detachment element is displaced so as to unlock the latching lug.

8. The plug-type connector arrangement according to claim 7, wherein the insulating housing comprises a raised tab that protrudes from the insulating housing, the raised tab spaced apart from the stop, wherein the tab, together with the stop, delimits an interspace in which the free end of the second actuating section enters.

9. The plug-type connector arrangement according to claim 7, wherein the insulating housing further comprises a depression, and the free end of the second actuating section enters the depression.

10. The plug-type connector arrangement according to claim 7, wherein the first actuating section is formed, as a spring-elastic section, integrally with the detachment element.

11. The plug-type connector arrangement according to claim 7, wherein the first actuating section and the second actuating section of the actuating member are formed integrally as a section of an elastic spring arm.

12. The plug-type connector arrangement according to claim 10, wherein the spring-elastic section or the elastic spring arm is configured to exert a restoring force on the detachment element, said restoring force being directed away from the latching lug of an opposing plug-type connector which is plugged onto the plug-type connector.

13. The plug-type connector arrangement according to claim 7, wherein the detachment element has, on a side facing the latching lug of the opposing plug-type connector, an unlocking contour, which tapers towards the free end and, on displacement of the detachment element, can be guided between the latching lug and the insulating housing of the plug-type connector.

14. The plug-type connector arrangement according to claim 7, wherein the detachment element has, on a side facing the latching lug of the opposing plug-type connector, an unlocking contour, which tapers towards the free end and, on displacement of the detachment element, can be guided between the latching lug and the insulating housing of the plug-type connector.

15. A plug-type connector arrangement, comprising:

a plug-type connector including at least one latching element;

an opposing plug-type connector including at least one latching lug, the plug type connector and opposing plug-type connector each comprising an insulating housing and plug-type contact elements arranged in the insulating housing, the plug-type contacts configured to plug together to make electrical contact with an associated plug-type contact element when in the plugged-together state, wherein the at least one latching element is configured to interact with the latching lug when in the plugged-together state so as to fasten the plug-type connector on the opposing plug-type connector, at least one detachment element operative to unlock the latching lug, the at least one detachment element arranged displaceably on the plug-type connector, wherein the at least one detachment element includes an actuating member having a first actuating section connected to the detachment element, and a second actuating section mounted movably relative to the first actuating section, the second actuating section configured to interact with the plug-type connector, wherein the first actuating section and the second actuating section form a toggle-lever mechanism for displacing the detachment element in the event of the action of force on the actuating member, and wherein an actuating force directed towards the insulating housing is converted by the toggle-lever mechanism, in intensified form, into a linear movement of the first actuating section towards the latching lug, thereby lifting the latching lug and unlocking the latching lug from the latching element.

16. The plug-type connector arrangement according to claim 15, wherein the first actuating section is formed, as a spring-elastic section, integrally with the detachment element.

17. The plug-type connector arrangement according to claim 16, wherein the spring-elastic section or the elastic spring arm exerts a restoring force on the detachment element, said restoring force being directed away from the latching lug of an opposing plug-type connector which is plugged onto the plug-type connector.

18. The plug-type connector arrangement according to claim 15, wherein the first actuating section and the second actuating section of the actuating member are formed integrally as a section of an elastic spring arm.

19. The plug-type connector arrangement according to claim 15, wherein the first actuating section of the actuating member is connected in rotationally articulated fashion to the second actuating section of the actuating member.

* * * * *